United States Patent [19]

Felix et al.

[11] 4,031,394

[45] June 21, 1977

[54] CAMERA DEVICE WITH RESISTIVE TARGET

[75] Inventors: Pierre Felix; Philippe Gamot; Guy Moiroud; Serge Veron, all of Paris, France

[73] Assignee: Thomson-CSF, Paris Cedex, France

[22] Filed: June 21, 1976

[21] Appl. No.: 697,750

[30] Foreign Application Priority Data

June 27, 1975 France ..... 75.20397

[52] U.S. Cl. ..... 250/333; 250/334; 313/180; 313/388

[51] Int. Cl.[2] ..... H01J 31/49

[58] Field of Search ..... 250/330, 333, 334; 178/DIG. 8; 313/180, 388

[56] References Cited

UNITED STATES PATENTS

| | | | |
|---|---|---|---|
| 2,234,328 | 3/1941 | Wolff | 250/330 X |
| 2,640,952 | 6/1953 | Swanson | 313/180 X |
| 2,735,019 | 2/1956 | Dewan et al. | 313/180 X |
| 3,239,605 | 3/1966 | Cholet et al. | 250/334 X |
| 3,774,043 | 11/1973 | LeCarvennec | 250/333 X |
| 3,950,645 | 4/1976 | Rotstein et al. | 250/333 X |

*Primary Examiner*—Archie R. Borchelt
*Attorney, Agent, or Firm*—Roland Plottel

[57] ABSTRACT

In camera using resistive targets wherein a recording tube of which the target (100) made of a pyroelectric material in the example and read by a beam of electrons, permanently receives a flow of ions formed in the tube by the collision between the electrons of the beam and the atoms of a gaseous mass of which the pressure in the tube is determined by the temperature of a reservoir, the invention provides means for controlling the temperature of the reservoir (filament 03) in dependence upon the average target current which is proportional to the flow of ions in question.

8 Claims, 5 Drawing Figures

206
AMPLIFIER
207
FILTER
208
$V_2$
209
AMPLIFIER
210
GAS RESERVOIR-HEATER SOURCE
211
CATHODE-HEATER SOURCE
212
BIASING SOURCE
213
BIASING SOURCE
214
VISUAL DISPLAY CHAIN
205
PRE-AMPLIFIER
105
100
106
110
103
01
02
03
1
2
3
4
201
BIASING SOURCE
200
202
MODULATOR ELECTRODE VOLTAGE SOURCE

206
FILTER AMPLIFIER
207
VISUAL DISPLAY CHAIN
214
PRE-AMPLIFIER
205
105
201
BIASING SOURCE
+
−
200
203
V1
AMPLIFIER
204
100
106
110
4
3
2
1
103
01
02
03
BIASING SOURCE
213
BIASING SOURCE
212
208
V2
AMPLIFIER
209
GAS RESERVOIR-HEATER SOURCE
210
CATHODE-HEATER SOURCE
211
MODULATOR ELECTRODE VOLTAGE SOURCE
202

CAMERA DEVICE WITH RESISTIVE TARGET

This invention relates to a camera of the resistive target type.

An example of a target of this kind are the pyroelectric targets, known in the art, used in heat-ray camera tubes. Hereinafter, this example will be used as a basis for defining the characteristic properties of the resistive target to which the invention applies, on the understanding that the invention is by no means limited to this example but applies generally to any target having these characteristics, including the piezoelectric targets used for obtaining acoustic images.

Heat-ray cameras use an electronic tube provided on its input surface with a target of a pyroelectric material. The heat radiation absorbed by the target traces on the target a temperature relief to which corresponds a potential relief which is an image of the subject from which the radiation emanates. At each point of the target, having a resistivity of the order of $10^{12}$ ohm-m, the spontaneous dielectric polarisation assumes a value governed by the thermal energy absorbed by that point. This image is read by a beam of electrons scanning the target point by point on its surface opposite the surface exposed to the incident radiation and depositing at each of its points the quantity of electrons required for neutralising the potential difference prevailing between the scanned point and the cathode at the moment the beam passes over that point. The flow of these charges in a resistance connected to the target forms the signal current, cf. U.S. Pat. No. 3,774,043, priority of 14th May, 1971. In tubes of this kind, this method of reading involves a known difficulty arising out of the constant sign of the charges deposited by the beam during its successive passages over the same point, namely that (negative) of the electrons of this beam. Now, between one passage of the beam over a point and its following passage over that point, the potential of this point relative to that which faces it on the opposite surface of the target, taken as reference, may have varied both in one direction and in the other and these variations may in particular be such that the potential of the scanned point falls below the potential of the cathode. It is clear that, in this case, the negative charges of the beam are incapable of neutralising the variations in polarisation in the two directions, but only those leaving the scanned point at a potential above that of the cathode.

Various measures have been proposed in the prior art for obviating this difficulty. One of them comprises depositing on that surface of the target scanned by the beam a quantity of positive ions which at any point add to the preceding signal potential a fixed positive potential which, in terms of absolute value, is higher than the signal potential so that the neutralisation to be effected is always in the same direction and may be accomplished by the negative charges of the electrons of the beam.

An arrangement such as this involves another difficulty, namely the stability as a function of time of the quantity of ions intercepted by each point of the target. This quantity must remain fixed during operation for each point.

The present invention relates to a camera device of the resistive target type comprising regulating means for ensuring this stability.

The invention will be better understood from the following description in conjunction with the accompanying drawings, in which:

FIG. 3, 4 and 5 are block diagrams of variants of the apparatus according to the invention.

Figure 1:
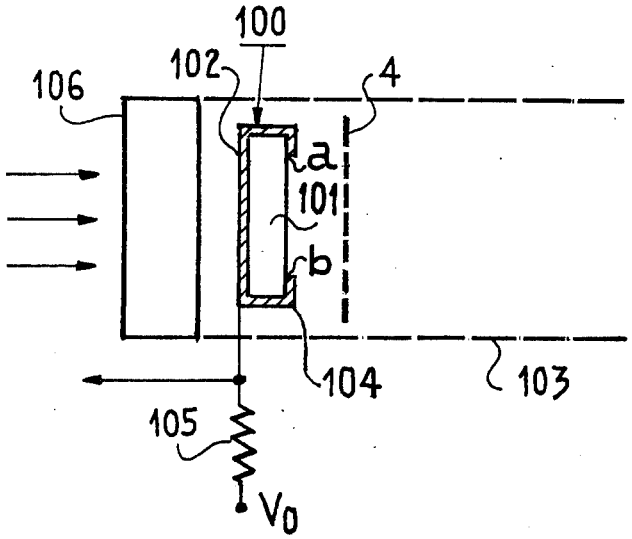
FIG. 1 is a diagram view illustrating part of the apparatus to which the invention relates.

In the tubes of the devices according to the invention, the ions are generated by the collision between the electrons of the beam and the molecules of a gas contained under low pressure in the tube. They are accelerated towards the target by the field existing between the target and an adjacent grid at a fixed positive potential relative to the target.

Under this fixed voltage, the flow of ions towards the target is directly proportional to the pressure of the gas. In order to ensure the required stability, therefore, it is this pressure which is manipulated in the cameras according to the invention. In a first variant, the pressure of the gas prevailing in the tube is controlled in dependence upon the flow of ions towards the target.

Since the flow of ions in question is generally proportional to the intensity of the beam of electrons, all other things being equal, the pressure of the gas is proportional to the preceding flow of ions and inversely proportional to the intensity of the beam of electrons. In a second variant of the invention, the pressure of the gas is controlled in dependence upon the ratio of the flow of ions to the flow of the beam which is itself regulated.

In another variant of the invention, means for controlling the beam flow are provided in addition to the control means of the first variant. All these variants are described by way of example in the following.

Now, in sealed tubes, such as are used in the devices according to the invention, the only accessible parameters are the voltages and currents of the various electrodes and the signal current.

This being the case, it is assumed in the construction of the devices according to the invention, as has been confirmed by experience, that the beam flow is proportional to the flow of electrons in the circuit of the grid referred to above. This current will be denoted $i_4$.

On the other hand, it is assumed that the current of the pyroelectric target is proportional to the number of ions intercepted by the target during this period, for example that of the line scan or of the frame scan.

The beam flow is controlled by a wehnelt, or modulator electrode, placed in the vicinity of the cathode of the tube. In the tubes of the devices according to the invention, the density of the gas in the tube in controlled by an element, or reservoir, placed in the tube and made of a material with an absorption capacity for the gas used which is dependent upon it temperature. In one preferred embodiment of the invention, this gas is hydrogen and the material in question titanium. Now, the solubility of hydrogen in titanium is known to decrease considerably when the temperature of the titanium increases beyond ambient temperature. The result of this is that the equilibrium pressure of the hydrogen in the tube is readily controllable by the temperature of the reservoir. The reservoir is generally in the form of a thin foil of titanium, with a thickness of the order of 50 micrometres, curved into cylindrical form around a heating filament. Experience has shown that, for concentrations of from 8 to 10% of hydrogen atoms in the titanium, it is easy by heating the reservoir to a temperature in the range from 350° C to 450° C to maintain an equilibrium pressure of the hydrogen in the tube of approximately $5.10^{-4}$ Torr for several hundred hours.

The target current referred to above has to be measured under certain conditions specified hereinafter if it is to be representative of the quantity of ions intercepted by the target.

To this end, in one of the variants of the invention, the target is formed in the manner illustrated in FIG. 1 to enable the flow of ions to be measured during operation. As shown in FIG. 1, this target is in the form of a thin foil of a pyroelectric material, such as glycocoll sulphate, coated over its surface exposed to the incident radiation (left-hand arrows) and opposite the surface scanned by the beam of electrons, with an electrically conductive layer or signal plate. This layer is extended by a similarly conductive edge overlapping the scanned surface, as shown in FIG. 1, where the target as a whole is denoted by the reference 100, the foil by the reference 101, the condutive layer by the reference 102 and the above-mentioned edge by the reference 104. In the Figure, the reference 103 denotes the tube wall whilst the reference 106 denotes its inlet opening.

Figure 2:
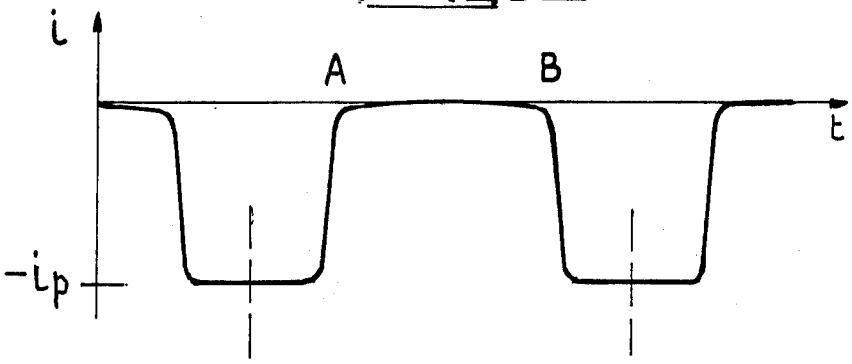
FIG. 2 is a graph relating to the embodiment illustrated in FIG. 1.

The signal plate 102 and the edge 104 are brought to a slightly negative potential $V_o$, for example - 5 volts, relative to the cathode taken as reference. When the target is scanned by the beam of electrons (not shown in the Figure) arriving from the right thereof, the edge 104 in view of its potential only receives ions accelerated towards the target by the grid 4 at a positive potential relative to the target of the order of + 250 volts. Accordingly, it is only that part of the target situated between the points *a* and *b* which intercepts electrons. During the scanning of a line of the target, the signal formed by the current i of the charges of the two signs intercepted by the target is collected. This current appears in the resistance 105. This signal has the shape, as a function of time, illustrated by the curve $i\ (t\ )$ in FIG. 2, this current being zero between the points *a* and *b* to which correspond the points A and B in FIG. 2, in view of the fact that this part of the target receives charges of both signs, and having the value - $i_P$ at the edge.

The signal is received at the input of the video amplifier (not shown) to which the resistance 105 is connected (arrow). The total duration of the cycle between the two vertical broken lines of the Figure is that of the line scan of the target, i.e. 64 microseconds for the usual standard of 625 lines at 25 images per second. The current $i_P$, known as the pedestal current, is generally in the range from 30 to 100 nanoampreres.

In the devices according to the invention in which the pedestal current is permanently taken from the target, formed in the manner described above, during the scanning thereof by the beam of electrons during the normal operation of the tube, the value of the signal used is equal to the mean value of the target current for the duration of one or more frames and, optionally, a large number of frames.

FIG. 3 diagrammatically illustrates one of the possible variants of the device according to the invention. In this Figure, the same elements are denoted by the same reference numerals as in FIG. 1. The tube 110 of the camera comprises a certain number of electrodes arranged for various purposes, as known in the art of electronic tubes, in the path of the beam (not shown) between the cathode 01 and the target 100. These electrodes are denoted by the reference 1, 2, 3 and 4, the last of these electrodes having already been mentioned in the description of FIG. 1. The reference 02 and 03 denote two heaters. The first is the heating filament of the cathode 01, whilst the second is used for heating the gas reservoir which has not been shown in the interests of clarity.

In the exemplary embodiment illustrated in the Figure, the heating of the gas reservoir in dependence upon the pedestral current $i_P$ is obtained as follows:

In a first operation, a voltage proportional to $i_P$ is formulated; this voltage is obtained from the output signal of the preamplifier 205. It is amplified (amplifier 206) and filtered (filter 207) in order to eliminate parasitic components such as those due to the line returns for example, and to retain only the envelope of this signal. This voltage is then compared with a reference voltage $V_2$, the resulting error signal, worked out in the potentiometer 208, controlling the heater supply of the gas reservoir (source 210) through the amplifier 209, as illustrated in the Figure.

In order to prevent an overrapid reaction of the control loop in the case of intense incident radiation, the electrical time constant of the control circuit in normal operation has to be high, i.e. of the order of 30 seconds. Nevertheless, an arrangement such as this has the disadvantage of increasing the stabilisation time of the pedestal current during starting of the tube. This difficulty may be obviated by providing a lower electrical time constant for starting up. To this end, there may be provided an additional means which, on either side of the nominal value, limits the range of values of the feed voltage of the filament 03 in the case of functional irregularities caused by overviolent incident radiation or by accidental elimination of the beam flow.

In FIG. 3, the reference 202 denotes the voltage source to which the modulator electrode 1 is connected. The reference 211, 212 and 213, respectively, denote the heater supply of the cathode 02 and the biasing sources used for polarising the electrodes 2 and 3. The reference 214 globally denotes the electronics of the visual display chain associated with the camera tube.

Figure 4:
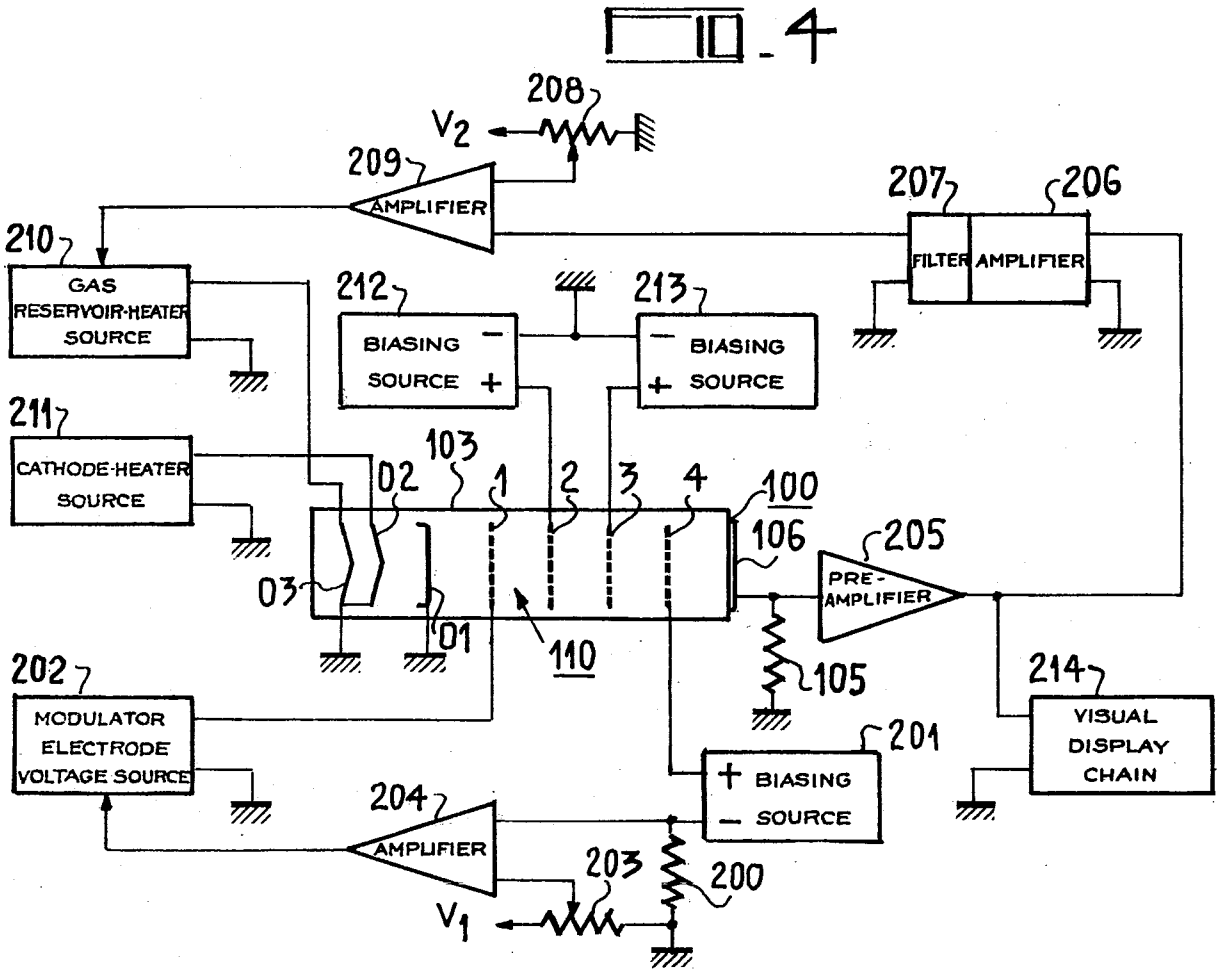
Figure 5:
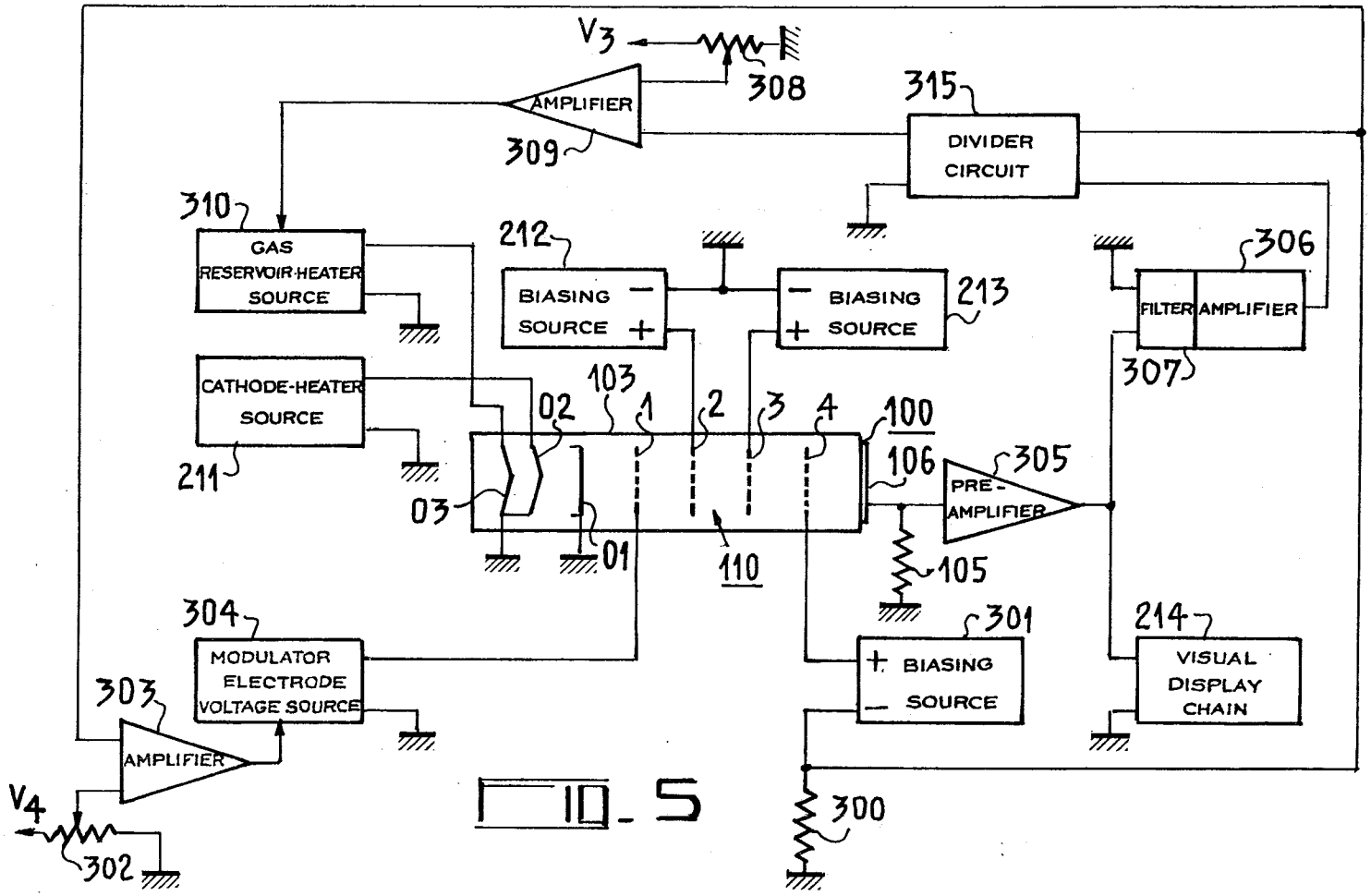

A second variant of the invention is shown in FIG. 4. This Figure shows all the elements of FIG. 3 with the same reference numerals. This variant is distinguished from the preceding variant by the fact that it additionally comprises a control loop for controlling the flow of electrons in dependence upon the grid current $i_4$ defined above.

Controlling the flow of the beam of electrons issuing from the cathode 01 in dependence upon a predetermined nominal value of the current $i_4$ is carried out as follows: The voltage measured at the terminals of the resistance 200 connected in series with the biasing source 201 of the grid 4 is compared with a reference voltage $V_1$. The error signal is formed by the difference between these two voltages as established in the potentiometer 203. It is amplified in the amplifier 204 and is injected into the feed circuit of the modulator electrode 1 (source 202) controlling the current emitted by the cathod 01, as shown in the Figure.

It will be noted that the electrical time constant of the control circuit should be low enough for the beam flow to be stabilised in a few seconds. However, in order to avoid excessive stressing of the cathode when the tube is started up, a delay of a few minutes may be provided in the camera before the control system comes into operation.

Figure 5:
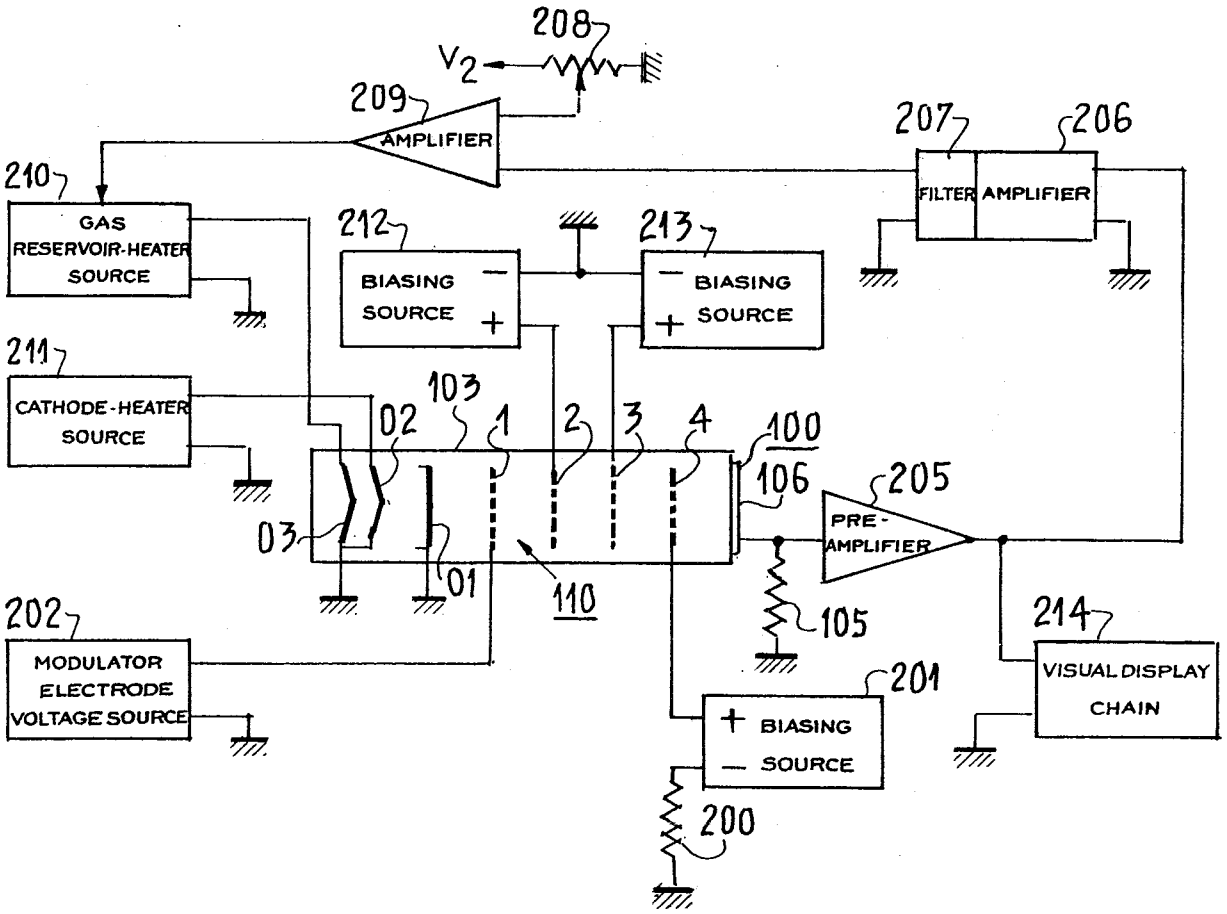

In another variant of the invention illustrated by way of example in FIG. 5, the temperature of the gas reservoir is no longer controlled in dependence upon the value of the current $i_P$, as in the preceding varaiants, but instead in dependence upon the ratio ($i_P/i_4$), the beam flow being controlled in dependence upon the current $i_4$ of the grid 4 just as in the second variant. In the Figure, the same elements bear the same references as in the preceding Figures.

The value of the ratio ($i_P/i_4$) is established in the divider circuit 315. The controls are carried out under conditions similar to those of the variant illustrated in FIG. 4, by means of elements bearing references 300 to 310, from two reference voltages $V_3$ and $V_4$.

The invention which has been described with reference to pyroelectric targets is generally applicable, as already mentioned, to any camera with a resistive target having the property of showing at each of its points a dielectric polarisation governed by the energy emanating from the subject absorbed by that point. The invention is applicable in particular to piezoelectric targets of the type used for the formation ultrasonic images.

In the case of pyroelectric targets, one of its applications is in the formulation of isotherm maps of fixed objects, human organs, especailly in the medical field where high stability of the signal current at each point is required.

What is claimed is:

1. A camera device with a resistive target comprising a camera tube having a target which in operation receives the energy emanating from the subject on one of its surfaces and which has the property of showing at each point between its two surfaces a dielectric polarisation governed by the energy absorbed by that point, means for generating inside said tube a beam of electrons issuing from a cathode and scanning point by point the other surface of said target so as to bring these points to the potential of said cathode and associated means for reading the signal current of flow of electrons desposited at each point of the target by said beam to obtain this potential, said tube comprising in its interior a first grid arranged in the vicinity of said cathode controlling the intensity of said beam, a heated ionisable gas reservoir made of a material of which the absorption capacity for said gas and hence the pressure of said gas in the tube is governed by its temperature, ions being generated in said tube by collision between the electrons of said beam and the molecules of said gas, and another grid arranged in the vicinity of said target and brought to a positive d.c. potential which is fixed in relation thereto, said camera device being characterised in that it comprises means for controlling the generation of said ions in the tube in dependence upon the average value of the target currents over a given period.

2. A camera device with resistive target as claimed in claim 1, wherein said means consist of means for controlling the temperature of said reservoir in dependence upon said mean value.

3. A camera device with a resistive target as claimed in claim 2, wherein it additionally comprises means for controlling the potential of said first grid in relation to that of said cathode in dependence upon the flow of electrons intercepted by said other grid.

4. A camera device with a resistive target as claimed in claim 1, wherein said means consist of means for controlling the temperature of said reservior in dependence upon the value of the ratio of said mean value to the flow of electrons intercepted by said other grid, and of means controlling the potential of said first grid relative to that of said cathode in dependence upon the flow of electrons intercepted by said other grid.

5. A camera device with a resistive target as claimed in claim 3, wherein said means for controlling the potential of said first grid comprises means for working out the voltage proportional to said flow of electrons and means for working out the voltage proportional to said flow of electrons and means for forming an error signal equal to the difference between this latter voltage and a first fixed voltage, and wherein the means controlling the temperature of said reservoir comprise means for working out a voltage proportional to said mean value and means for forming an error signal equal to the difference between this latter voltage and a second fixed voltage.

6. A camera device with a resistive target as claimed in claim 1, wherein said gas is hydrogen and said material is titanium.

7. A camera device with a resitive target as claimed in claim 1, wherein said target is a pyroelectric target.

8. A camera device with a resistive target as claimed in claim 7, wherein said target comprises an electrically conductive edge on its scanned surface and wherein said target current is the difference between the current of that part of the target comprised inside said edge and that of the edge.

* * * * *